US010446969B2

(12) United States Patent
Bhat et al.

(10) Patent No.: US 10,446,969 B2
(45) Date of Patent: Oct. 15, 2019

(54) ELECTRICAL CONNECTOR WITH TERMINAL POSITION ASSURANCE MEMBER

(71) Applicants: TE CONNECTIVITY INDIA PRIVATE LIMITED, Bangalore (IN); TYCO ELECTRONICS BRASIL LTDA, Braganca Paulista (BR)

(72) Inventors: Gajanan Bhat, Bangalore (IN); Fabio Fortunato Christiano, São Paulo (BR); Raghunandan S. Shanbhag, Bangalore (IN); Tejus Kiran Salaka, Bengaluru (IN)

(73) Assignees: TE Connectivity India Private Limited, Karnataka (IN); TE Connectivity Brasil Industria De Electronics, Sao Paulo (BR)

( * ) Notice: Subject to any disclaimer, the term of this patent is extended or adjusted under 35 U.S.C. 154(b) by 0 days.

(21) Appl. No.: 15/984,780

(22) Filed: May 21, 2018

(65) Prior Publication Data

US 2019/0173220 A1 Jun. 6, 2019

(30) Foreign Application Priority Data

Dec. 1, 2017 (IN) ..... 2017/11043176

(51) Int. Cl.
*H01R 13/422* (2006.01)
*H01R 24/20* (2011.01)
(Continued)

(52) U.S. Cl.
CPC ..... *H01R 13/4365* (2013.01); *H01R 13/4362* (2013.01); *H01R 13/642* (2013.01);
(Continued)

(58) Field of Classification Search
CPC ..... H01R 13/4223; H01R 13/642; H01R 13/4365; H01R 13/514; H01R 13/5816; H01R 24/20
See application file for complete search history.

(56) References Cited

U.S. PATENT DOCUMENTS 7,278,883 B2 * 10/2007 Tyler ..... H01R 13/4223 439/595
9,147,957 B2 * 9/2015 Randolph ..... H01R 13/424
(Continued)

FOREIGN PATENT DOCUMENTS

FR 2812458 A1 2/2002

OTHER PUBLICATIONS

International Search Report, International Application No., PCT/IB2018/058914, International Filing Date, Nov. 13, 2018.

*Primary Examiner* — Briggitte R. Hammond

(57) ABSTRACT

An electrical connector includes a housing and a terminal position assurance (TPA) member. The housing defines cavities that extend from a cable end of the housing parallel to a cavity axis and hold corresponding terminals therein. The housing includes first and second walls defining a TPA slot therebetween that is open to the cavities. The TPA member is mounted to the housing within the TPA slot such that a front side of the TPA member engages the first wall and a rear side of the TPA member engages the second wall. The TPA member is movable relative to the housing between an unlocked position and a locked position along an actuation axis perpendicular to the cavity axis. The TPA member in the locked position extends into the cavities, and the front side of the TPA member engages the terminals to retain the terminals within the housing.

19 Claims, 8 Drawing Sheets

(51) Int. Cl.

| | |
|---|---|
| ***H01R 13/436*** | (2006.01) |
| ***H01R 13/514*** | (2006.01) |
| ***H01R 13/642*** | (2006.01) |
| *H01R 13/58* | (2006.01) |
| *H01R 13/629* | (2006.01) |
| *H01R 24/28* | (2011.01) |

(52) U.S. Cl.
CPC ..... *H01R 24/20* (2013.01); *H01R 13/4223* (2013.01); *H01R 13/514* (2013.01); *H01R 13/5816* (2013.01); *H01R 13/62938* (2013.01); *H01R 24/28* (2013.01); *H01R 2201/26* (2013.01)

(56) References Cited

U.S. PATENT DOCUMENTS

| | | | | |
|---|---|---|---|---|
| 9,153,894 | B2 * | 10/2015 | Gerwatowski | H01R 13/4223 |
| 9,455,523 | B1 * | 9/2016 | Sundarakrishnamachari | H01R 13/62927 |
| 2003/0008557 | A1 | 1/2003 | Suzuki | |
| 2006/0172612 | A1 * | 8/2006 | Wasalaski | H01R 13/447 439/752 |
| 2015/0200483 | A1 * | 7/2015 | Martin | H01R 13/40 439/489 |
| 2017/0033490 | A1 * | 2/2017 | Wang | H01R 11/05 |
| 2018/0309237 | A1 * | 10/2018 | Lesniak | H01R 13/6295 |

* cited by examiner

ELECTRICAL CONNECTOR WITH TERMINAL POSITION ASSURANCE MEMBER

CROSS-REFERENCE TO RELATED APPLICATIONS

This application claims priority to India Patent Application No. 2017/11043176, which was filed Dec. 1, 2017 and is titled Electrical Connector With Terminal Position Assurance Member. The subject matter of which is herein incorporated by reference in its entirety.

BACKGROUND OF THE INVENTION

The subject matter herein relates generally to electrical connectors that have terminal position assurance devices or members to ensure that electrical terminals are properly loaded and secured within connector housings.

Electrical connectors typically include electrical terminals that are held within an insulative housing. The electrical terminals have to be properly positioned or seated within the housing in order to successfully mate to a corresponding electrical contact of a mating connector. If one or more of the terminals are not properly positioned, the connector may not operate as intended when mated to the mating connector. Once a malfunction is detected, it may be difficult to determine which of the terminals is at fault due to the number of terminals in the housing and poor accessibility of the terminals within the housing. Another concern with electrical connectors is retention of the terminals. For example, some terminals are retained within a cavity of the housing via small retention features, such as latches, that extend between the terminal and the housing within the cavity. However, the retention features may not be sufficiently robust to withstand pulling forces exerted on cables attached to the terminals, causing the retention features to fail and allowing the terminals to be pulled out of position.

A need remains for an electrical connector having an insertable device or member that robustly secures the terminals in the cavities of the housing and ensures that the terminals are properly positioned in the housing prior to mating the connector to a complementary mating connector.

BRIEF DESCRIPTION OF THE INVENTION

In one or more embodiments of the present disclosure, an electrical connector is provided that includes a housing and a terminal position assurance (TPA) member. The housing has a mating end and a cable end. The housing defines cavities that extend from the cable end parallel to a cavity axis. The cavities hold corresponding terminals therein that are connected to one or more cables protruding from the cable end. The housing further includes a first wall and a second wall that define a TPA slot therebetween. The TPA slot is open to the cavities. The TPA member is mounted to the housing within the TPA slot. The TPA member has a front side that engages the first wall of the housing and a rear side that engages the second wall of the housing. The TPA member is movable relative to the housing between an unlocked position and a locked position along an actuation axis that is perpendicular to the cavity axis. The TPA member in the locked position extends into the cavities, and the front side of the TPA member engages respective back edges of the terminals to retain the terminals within the housing.

In one or more embodiments of the present disclosure, an electrical connector is provided that includes a housing and a terminal position assurance (TPA) member. The cable end of the housing is oriented perpendicular to the mating end. The housing defines cavities that extend from the cable end parallel to a cavity axis. The cavities hold corresponding terminals therein that are connected to one or more cables protruding from the cable end. The mating end defines an opening configured to receive a mating connector therein along a mating axis that is perpendicular to the cavity axis. The housing further includes a first wall and a second wall that define a TPA slot therebetween. The TPA slot is open to the cavities. The TPA member is mounted to the housing within the TPA slot. The TPA member has a front side that engages the first wall of the housing and a rear side that engages the second wall of the housing. The TPA member is movable relative to the housing between an unlocked position and a locked position along an actuation axis that is perpendicular to the cavity axis and parallel to the mating axis. The TPA member extends farther into the cavities and is spaced farther away from the mating end of the housing when in the locked position relative to the unlocked position.

In one or more embodiments of the present disclosure, an electrical connector is provided that includes a housing and a terminal position assurance (TPA) member. The housing defines cavities that extend from the cable end parallel to a cavity axis. The cavities are disposed side by side in a row and contain corresponding terminals therein. The housing further includes a first wall and a second wall that define a TPA slot therebetween. The TPA slot extends across the cavities in the row and is open to the cavities. The TPA member is mounted to the housing within the TPA slot. The TPA member has a front side that engages the first wall of the housing and a rear side that engages the second wall of the housing. The front and rear sides of the TPA member extend between top and bottom ends of the TPA member. The TPA member is movable relative to the housing between an unlocked position and a locked position along an actuation axis that is perpendicular to the cavity axis. When the TPA member is in the locked position, the bottom end is disposed within the cavities and an upper portion of the TPA member is disposed in the TPA slot of the housing between the first and second walls. A lower portion of the TPA member within the cavities engages respective back edges of the terminals to block movement of the terminals towards the cable end.

DETAILED DESCRIPTION OF THE INVENTION

Figure 1:
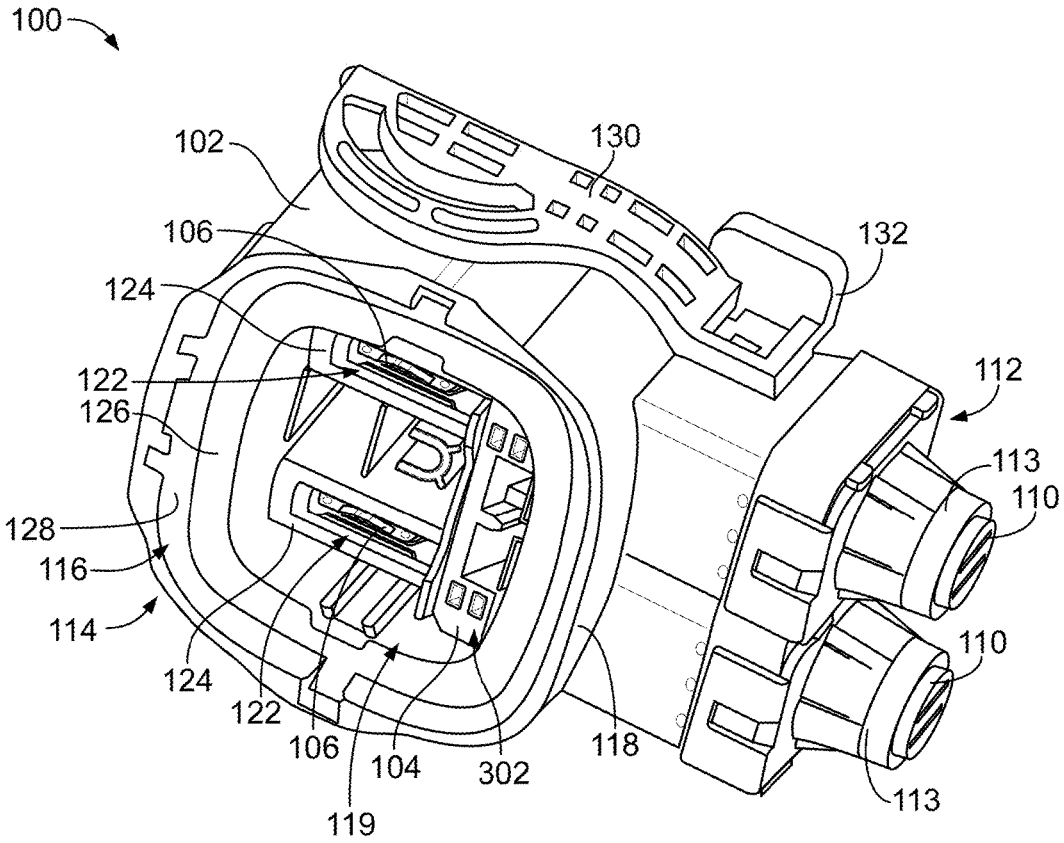
FIG. 1 is a perspective view of an electrical connector in accordance with an embodiment.
Figure 2:
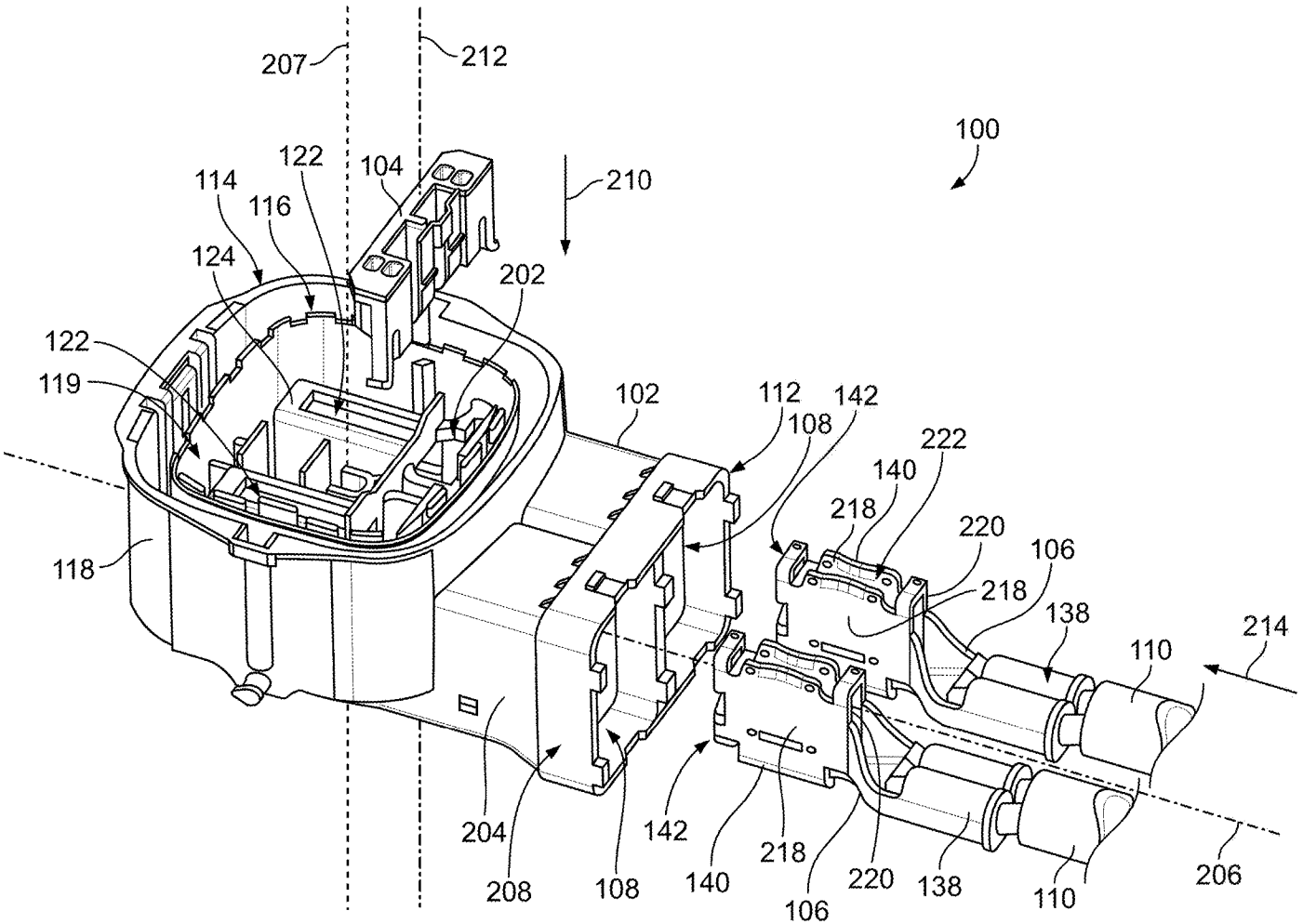
FIG. 2 is an exploded perspective view of the electrical connector according to an embodiment.

FIG. 1 is a perspective view of an electrical connector 100 in accordance with an embodiment. The electrical connector 100 includes a housing 102, a terminal position assurance (TPA) member 104, and multiple terminals 106. The terminals 106 are held within corresponding cavities 108 (shown in FIG. 2) defined in the housing 102. The terminals 106 are electrically connected and mechanically secured to one or more cables 110 that protrude from the housing 102 at a cable end 112 of the housing 102. Only short segments of the cables 110 are shown in FIGS. 1 and 2, but the cables 110 may have an extended length to connect the electrical connector 100 to a designated device, such as a battery, a computer, or the like. The electrical connector 100 in the illustrated embodiment holds two terminals 106, but may be configured to hold a single terminal 106 or at least three terminals 106 in other embodiments. The illustrated embodiment includes two cables 110 protruding separately from the cable end 112 of the housing 102, but the two cables 110 may be collectively surrounded by an outer jacket in an alternative embodiment. The electrical connector 100 optionally includes cable strain relief devices 113 mounted to the cable end 112 of the housing 102 and individually surrounding the cables 110 to provide strain relief and/or sealing of the housing 102 from dirt and debris.

In the illustrated embodiment, the housing 102 includes the cable end 112 and a mating end 114. The mating end 114 defines a mating interface for engaging a mating connector (not shown) during a mating operation. For example, the mating end 114 defines an opening 116 that receives the mating connector therethrough during the mating operation to allow mating contacts (not shown) of the mating connector to engage and electrically connect to the terminals 106.

The housing 102 may include a mating shroud 118 at the mating end 114 that defines a socket 119 extending into the housing 102 from the opening 116. The mating connector enters the socket 119 to engage the terminals 106. The housing 102 may define contact openings 122 within the socket 119 that provide access to the terminals 106. For example, the housing 102 may include a corresponding support box 124 for each of the terminals 106. The support boxes 124 are located within the socket 119 and define the contact openings 122. The support boxes 124 are configured to guide the mating contacts of the mating connector into engagement with the terminals 106 without stubbing against the terminals 106. In the illustrated embodiment, the TPA member 104 is mounted to the housing 102 and disposed within the socket 119. For example, the TPA member 104 is circumferentially surrounded by the mating shroud 118. The TPA member 104 is disposed proximate to the support boxes 124.

The electrical connector 100 optionally includes a liner 126 held within the mating shroud 118. The liner 126 may include a rubber material, a rubber-like material, or a plastic material that is held along an interior surface 128 of the mating shroud 118. The liner 126 may surround the TPA member 104 and the support boxes 124 of the housing 102. Optionally, the liner 126 may compress between the mating shroud 118 and a housing (not shown) of the mating connector during the mating operation to seal the interface, preventing debris and contaminants from entering the socket 119. The liner 126 may be a gasket, an O-ring, or the like.

The electrical connector 100 in the illustrated embodiment also includes a locking lever 130 that is coupled to the housing 102 and pivotable relative to the housing 102. The locking lever 130 has a handle 132 configured to be actuated by an operator or user to pivot the lever 130 relative to the housing 102. The locking lever 130 engages the mating connector and pulls the mating connector into the socket 119 as the operator pivots the lever 130. The locking lever 130 may be configured to provide a mechanical advantage during the mating operation, reducing the amount of force exerted by the operator relative to mating the electrical connector 100 to the mating connector without the use of the locking lever 130. The locking lever 130 may also selectively secure or lock the mating connector to the electrical connector 100 in a mated position, preventing the mating connector from un-mating the connector 100. The locking lever 130 is optional, as the electrical connector 100 may omit the locking lever 130 in an alternative embodiment.

In an embodiment, the electrical connector 100 is a right angle connector. The housing 102 is shaped such that the cable end 112 of the housing 102 is oriented perpendicular to the mating end 114 of the housing 102. For example, a plane of the cable end 112 is oriented generally perpendicular (e.g., within plus or minus ten degrees from a right angle) relative to a plane of the mating end 114. The electrical connector 100 may be a plug connector that releasably mates to a mating header connector that is fixed in place on a device, such as a chassis, battery case, or the like. In one non-limiting application, the electrical connector 100 may be installed within a vehicle, such as an electric automobile. In an alternative embodiment, the electrical connector 100 may be an in-line or straight connector, such that the housing 102 extends linearly between the cable end 112 and the mating end 114, and the cable and mating ends 112, 114 are oriented parallel to each other.

FIG. 2 is an exploded perspective view of the electrical connector 100 according to an embodiment. In FIG. 2, two terminals 106 are poised for loading into the cavities 108 of the housing 102 through the cable end 112, and the TPA member 104 is poised for mounting to the housing 102. The liner 126 and locking lever 130 (shown in FIG. 1) are not shown in FIG. 2. The housing 102 in an embodiment includes a neck portion 204 that extends from the mating shroud 118 of the housing 102 to the cable end 112.

The cavities 108 are open at the cable end 112 and extend through the neck portion 204 towards the socket 119. The cavities 108 extend through the neck portion 204 into the corresponding support boxes 124 within the socket 119 of the mating shroud 118. For example, the cavities 108 are open, or fluidly connected, to the socket 119 through the contact openings 122 of the support boxes 124. In an embodiment, the cavities 108 extend parallel to a cavity axis 206, such that the cavities 108 are parallel to each other. The cavity axis 206 in the illustrated embodiment is perpendicular to a mating axis 207 along which the mating connector is received into the socket 119 of the mating shroud 118. The cavities 108 may be disposed side-by-side in the neck portion 204 along a row 208. Although the housing 102 only includes two cavities 108 in the illustrated embodiment, the housing 102 may include more or less than two cavities 108 in other embodiments.

The housing 102 defines a TPA slot 202 that receives the TPA member 104. The TPA slot 202 may be adjacent to the support boxes 124 of the housing 102. In an embodiment, the TPA slot 202 is disposed within the socket 119 of the mating shroud 118. In an alternative embodiment, the TPA slot 202 may be located along the neck portion 204 of the housing 102 instead of within the socket 119. The TPA slot 202 is open or fluidly connected to the cavities 108. For example, the TPA slot 202 may extend across the cavities 108 in the row 208. The TPA slot 202 in the illustrated embodiment extends across both of the two cavities 108, and is fluidly connected to both cavities 108.

The TPA member 104 is configured to be inserted into the TPA slot 202 in a loading direction 210 parallel to an actuation axis 212. In the illustrated embodiment, the TPA member 104 is loaded into the TPA slot 202 through the opening 116 at the mating end 114 of the housing 102. When the TPA member 104 is mounted to the housing 102, the TPA member 104 is selectively movable relative to the housing 102 along the actuation axis 212 between an unlocked position and a locked position. For example, during assembly of the electrical connector 100, the TPA member 104 may be disposed in the unlocked position. Once the terminals 106 are loaded within the cavities 108, an operator may move the TPA member 104 to the locked position. In the locked position, the TPA member 104 is configured to protrude into the cavities 108 to secure the terminals 106 in the housing 102. For example, the TPA member 104 in the locked position extends into each of the cavities 108 to block retreat of the terminals 106 out of the cavities 108 through the cable end 112. The TPA member 104 may provide a primary and/or sole means of retaining the terminals 106 in the housing 102, or alternatively may provide a secondary retaining means that supports a primary lock, such as deflectable spring beams (not shown) on the terminals 106 or within the cavities 108. The TPA member 104 in the unlocked position does not extend as far into the cavities 108, relative to the locked position, which allows the terminals 106 to be loaded into and removed (e.g., unloaded) from the cavities 108. The actuation axis 212 may be transverse to the cavity axis 206. For example, the actuation axis 212 may be perpendicular to the cavity axis 206.

The TPA member 104 may also provide terminal position assurance to indicate if any of the terminals 106 are not properly positioned within the housing 102. For example, if one or more of the terminals 106 are not fully loaded within the corresponding cavity 108, such terminal(s) 106 may obstruct movement of the TPA member 104 towards the locked position, providing a tactile and/or visual indication to the operator. The TPA member 104 may include an electrically insulative (e.g., dielectric) material, such as one or more plastics. Alternatively, the TPA member 104 may include one or more metals. The TPA member 104 may be formed by a molding process.

The terminals 106 of the electrical connector 100 are configured to be loaded into the cavities 108 through the cable end 112. The terminals 106 are loaded in a loading direction 214 that is parallel to the cavity axis 206. Each of the terminals 106 is loaded into a different one of the cavities 108. The terminals 106 of the electrical connector 100 each have a crimp barrel 138 and a contact segment 140. The crimp barrels 138 are crimped onto the respective cables 110. The contact segments 140 define distal ends 142 of the terminals 106 that are farthest from the cables 110. The contact segments 140 in the illustrated embodiment are blade receptacles configured to receive blade contacts of the mating connector therein through the contact openings 122 of the housing 102. Each of the contact segments 140 has two parallel side panels 218 extending from the distal end 142 to a back edge 220 of the contact segment 140. The back edge 220 faces towards the respective crimp barrel 138. The side panels 218 are spaced apart from each other to define a slot 222 that receive a corresponding mating blade contact therein. In an alternative embodiment, the terminals 106 may have different types of contact segments 140, such as round socket-style contacts, deflectable beam-style contacts, blade contacts, pin contacts, or the like. The terminals 106 may be configured to convey electrical power from the cables 110 to the mating connector that mates to the electrical connector 100. For example, the terminals 106 may convey high voltage electrical current up to or exceeding 1000 V. Alternatively, or in addition, the terminals 106 may be configured to convey electrical signals.

The electrical connector 100 may be used in various different applications, such as with vehicles, appliances, industrial machinery, and the like. In one non-limiting example, the electrical connector 100 may be installed within an electric vehicle. For example, the electrical connector 100 may represent part of, or connect to, a charger inlet harness of the vehicle that is used to charge a battery of the vehicle.

Figure 3:
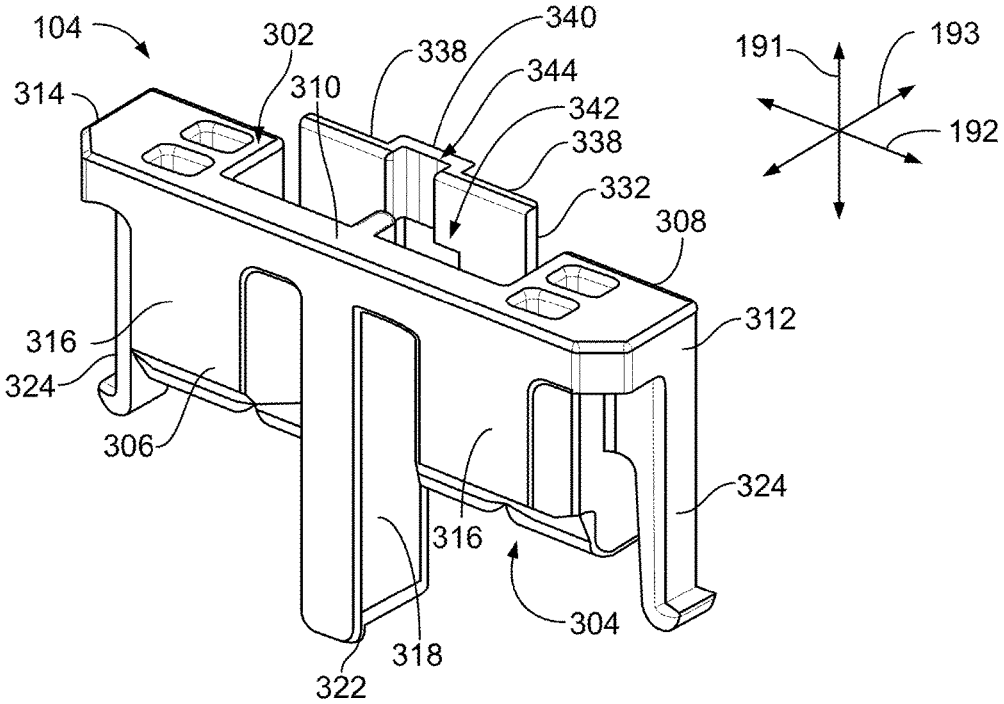
FIG. 3 is a top front perspective view of a terminal position assurance (TPA) member of the electrical connector according to an embodiment.
Figure 4:
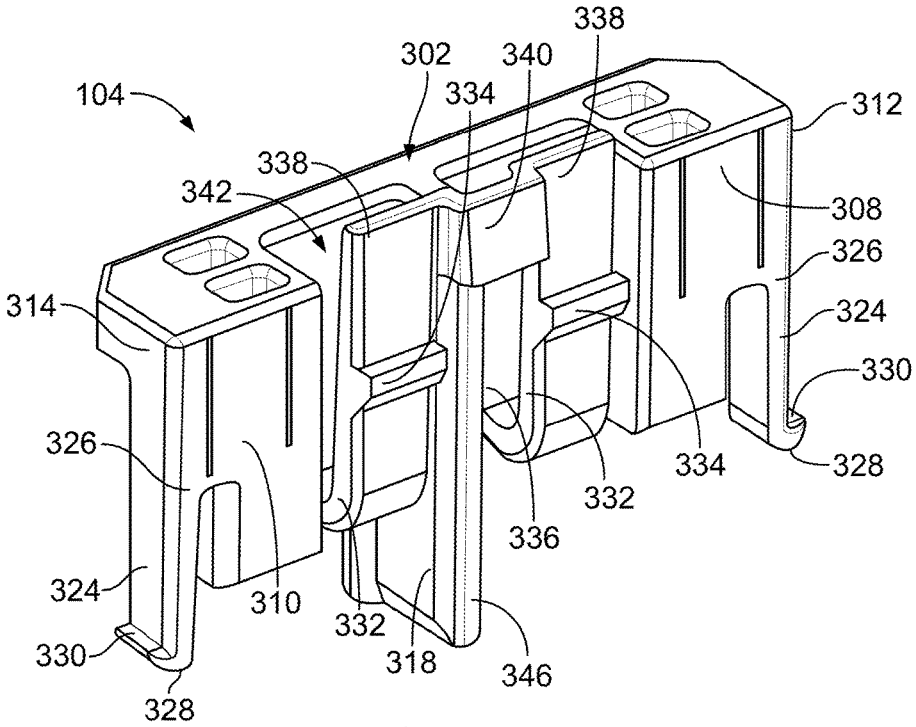
FIG. 4 is a top rear perspective view of the TPA member of the electrical connector according to an embodiment.
Figure 5:
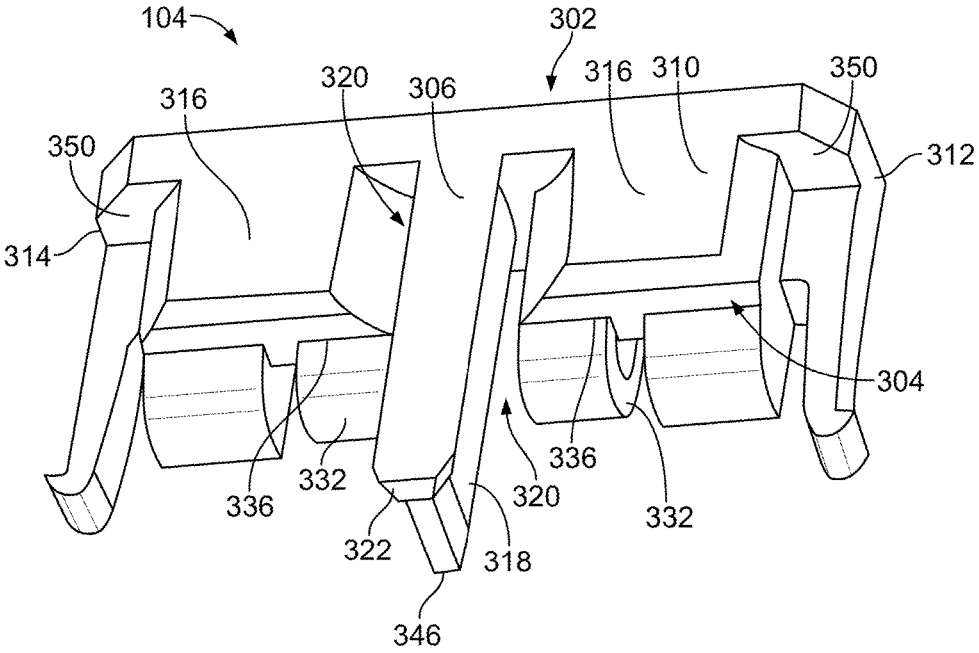
FIG. 5 is a bottom front perspective view of the TPA member of the electrical connector according to an embodiment.
Figure 6:
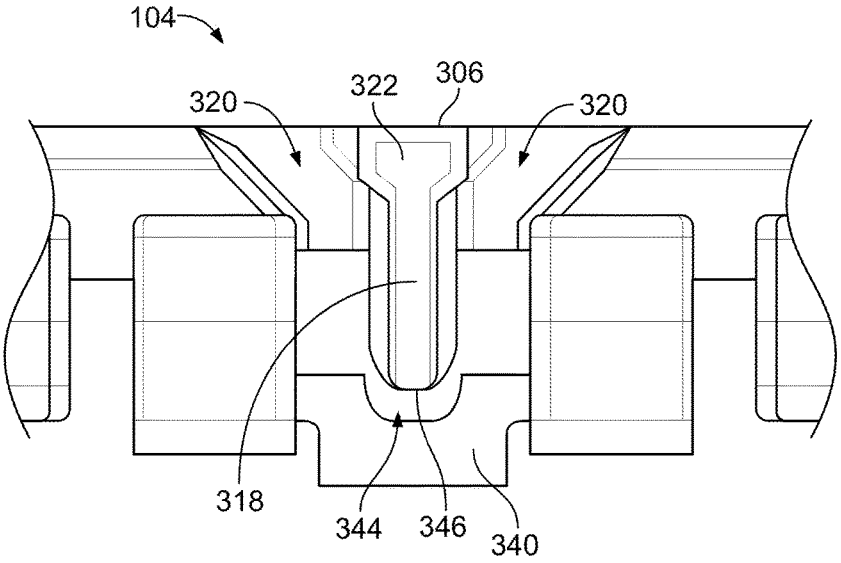
FIG. 6 is a bottom plan view of a portion of the TPA member of the electrical connector according to an embodiment.

FIGS. 3-6 illustrate different views of the TPA member 104 of the electrical connector 100 according to an embodiment. For example, FIG. 3 is a top front perspective view of the TPA member 104. FIG. 4 is a top rear perspective view of the TPA member 104. FIG. 5 is a bottom front perspective view of the TPA member 104. FIG. 6 is a bottom plan view of a portion of the TPA member 104. In FIGS. 3-6, the TPA member 104 is oriented with respect to a vertical or elevation axis 191, a lateral axis 192, and a longitudinal or depth axis 193. The axes 191-193 are mutually perpendicular. Although the vertical axis 191 appears to extend generally parallel to gravity, it is understood that the axes 191-193 are not required to have any particular orientation with respect to gravity.

The TPA member 104 has a front side 306 and a rear side 308 that is opposite to the front side 306. The TPA member 104 extends laterally (e.g. along the lateral axis 192) between a first edge side 312 and a second edge side 314 that is opposite the first edge side 312. As used herein, relative or spatial terms such as "top," "bottom," "upper," "lower," "front," and "rear" are only used to distinguish the referenced elements in the illustrated orientation and do not necessarily require particular positions or orientations in the surrounding environment of the TPA member 104 or the electrical connector 100.

The TPA member 104 includes a body 310 and multiple features, such as latches, posts, and the like, extending from the body 310. The TPA member 104 may have a unitary, one-piece construction such that the features are integrally connected to the body 310 (e.g., without using any fasteners, adhesives, or the like). Since the features are integral to the body 310, the TPA member 104 may lack seams between the body 310 and the features. The body 310 extends between a top end 302 and a bottom end 304 that is opposite to the top end 302. The front and rear sides 306, 308 extend vertically (e.g., along the vertical axis 191) from the top end 302 to the bottom end 304. When the TPA member 104 is mounted within the TPA slot 202 (shown in FIG. 2) of the housing 102 (FIG. 2) in the locked position, the top end 302 may face outward towards the mating end 114 (FIG. 2) of the housing 102, as shown in FIG. 1.

With reference to FIG. 3, the front side 306 of the TPA member 104 includes blocking surfaces 316 along the body 310. The blocking surfaces 316 are planar. Each of the blocking surfaces 316 is configured to align with a different one of the cavities 108 (FIG. 2). When the TPA member 104 is in the locked position, the blocking surfaces 316 extend into the corresponding cavities 108 and provide hard stop surfaces that engage the terminals 106 (FIG. 2), blocking retreat of the terminals 106 towards the cable end 112 of the housing 102.

The TPA member 104 includes a guide post 318 that protrudes beyond the bottom end 304 of the body 310. The guide post 318 is configured to guide the insertion of the TPA member 104 into the TPA slot 202 (FIG. 2) of the housing 102. The guide post 318 is located between the two blocking surfaces 316 in the illustrated embodiment. As shown in FIGS. 5 and 6, the TPA member 104 includes a gap 320 on either side of the guide post 318 that separates the guide post 318 from the blocking surfaces 316. The guide post 318 optionally includes a keying feature 322. The keying feature 322 in the illustrated embodiment is an enlarged head portion of the guide post 318 at the front side 306, such that the guide post 318 is wider at the front side 306 than at a rear edge 346 of the guide post 318. The keying feature 322 may support proper alignment of the TPA member 104 relative to the housing 102 by allowing the guide post 318 to enter a complementary guide channel 402 (shown in FIG. 7) of the housing 102 in only a single orientation. For example, the guide post 318 may not fit within the guide channel 402 in other orientations besides the proper designated orientation due to the keying feature 322. In alternative embodiments, the TPA member 104 may include multiple guide posts 318, or may omit the guide post 318.

Referring now to FIG. 4, the TPA member 104 may include deflectable mounting latches 324 configured to secure the TPA member 104 onto the housing 102 (FIG. 2). For example, the mounting latches 324 prevent the TPA member 104 from moving upward along the actuation axis 212 (FIG. 2) beyond the unlocked position and disengaging the housing 102. In an embodiment, the TPA member 104 includes a mounting latch 324 at each of the first and second edge sides 312, 314. The mounting latches 324 are cantilevered to extend from a respective fixed end 326 at the body 310 to a respective distal hook end 328. The hook ends 328 of the mounting latches 324 have catch surfaces 330. In the illustrated embodiment, the mounting latches 324 extend vertically downward from the fixed ends 326 to the distal hook ends 328.

With specific reference to FIG. 4, the TPA member 104 may include one or more deflectable locking latches 332 disposed along the rear side 308. The TPA member 104 in the illustrated embodiment includes two locking latches 332. Each of the locking latches 332 includes a ridge 334 protruding rearward from the respective locking latch 332. As shown in FIGS. 4 and 5, the locking latches 332 extend from respective fixed ends 336 at the body 310 to respective distal, free ends 338, which are spaced apart from the body 310 and movable relative to the body 310. The fixed ends 336 are disposed at the bottom end 304 of the body 310 of the TPA member 104, and the locking latches 332 extend generally vertically upward towards the top end 302. For example, the free ends 338 are located more proximate to the top end 302 than the proximity of the fixed ends 336 to the top end 302. The locking latches 332 may have "J" shapes that curve from the bottom end 304 towards the top end 302.

In the illustrated embodiment, the distal, free ends 338 of the two locking latches 332 are connected to each other via a tab member 340 that bridges the two distal, free ends 338. The tab member 340 may be integrally connected to the distal, free ends 338. The tab member 340 is located at or proximate to the top end 302 of the TPA member 104. In an embodiment, the tab member 340 is configured to be moved by an operator to actuate the locking latches 332, as described in more detail herein. As shown in FIGS. 3 and 4, the distal, free ends 338 of the locking latches 332 and the tab member 340 are spaced apart from the body 310 at the top end 302 via a clearance gap 342. In an embodiment, the distal, free ends 338 of the locking latches 332 and the tab member 340 move into the clearance gap 342 when the locking latches 332 are deflected from the illustrated resting position. The tab member 340 may include a recess 344 that aligns with the guide post 318, allowing the locking latches 332 to deflect into the clearance gap 342 at least partially beyond the rear edge 346 of the guide post 318, as shown in FIG. 6.

With specific reference to FIG. 5, the TPA member 104 may include two overhanging shelf portions 350. One of the shelf portions 350 is located at a corner between the front side 306 and the first edge side 312, and the other shelf portion 350 is located at a corner between the front side 306 and the second edge side 314. The shelf portions 350 are configured to engage the housing 102 (FIG. 2) when the TPA member 104 is in the locked position to prevent the TPA member 104 from moving along the actuation axis 212 (FIG. 2) in the loading direction 210 (FIG. 2) beyond the locked position.

Figure 7:
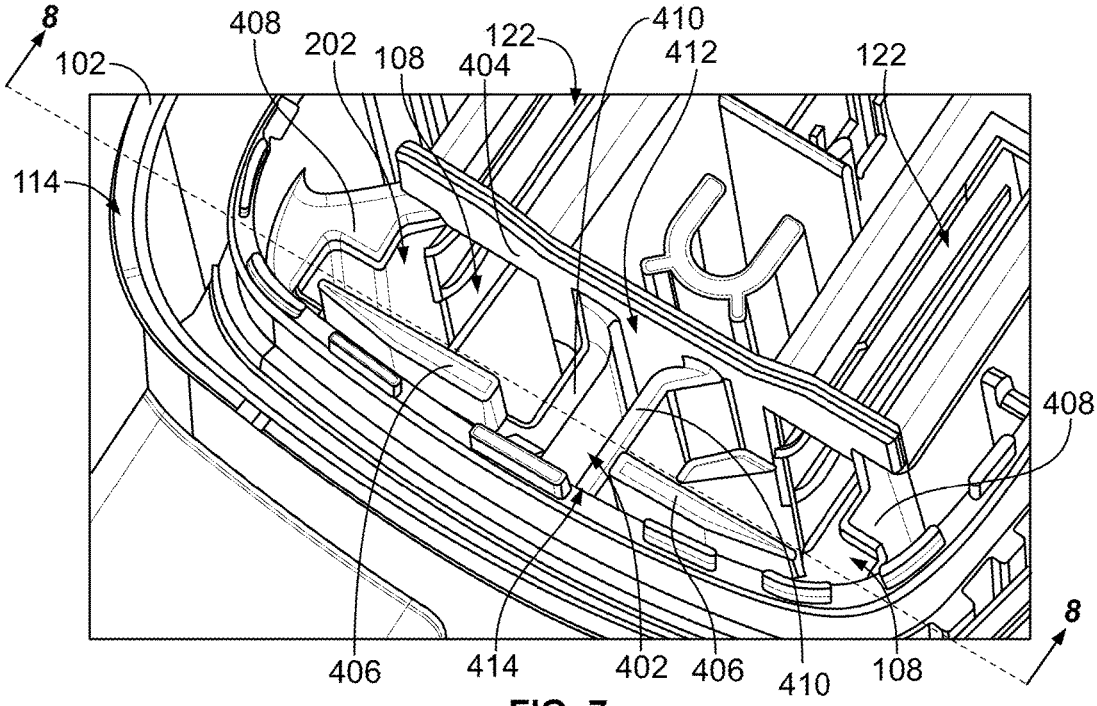
FIG. 7 is a perspective view of a portion of a housing of the electrical connector according to an embodiment showing a TPA slot.

FIG. 7 is a perspective view of a portion of the housing 102 of the electrical connector 100 according to an embodiment showing the TPA slot 202. The TPA slot 202 is defined between a first wall 404 and a second wall 406. The first wall 404 optionally extends between and divides the TPA slot 202 from the cavity openings 122. The TPA slot 202 extends through a platform 408 into the cavities 108. The first and second walls 404, 406 extend from the platform 408 towards the mating end 114 of the housing 102, as shown clearly in FIG. 9. The first and second walls 404, 406 of the housing 102 may extend parallel to each other along a least a portion of the lateral lengths of the walls 404, 406. In the illustrated embodiment, the second wall 406 defines a cutout region 414 that is configured to accommodate the tab member 340 of the TPA member 104 (shown in FIG. 4).

Figure 8:
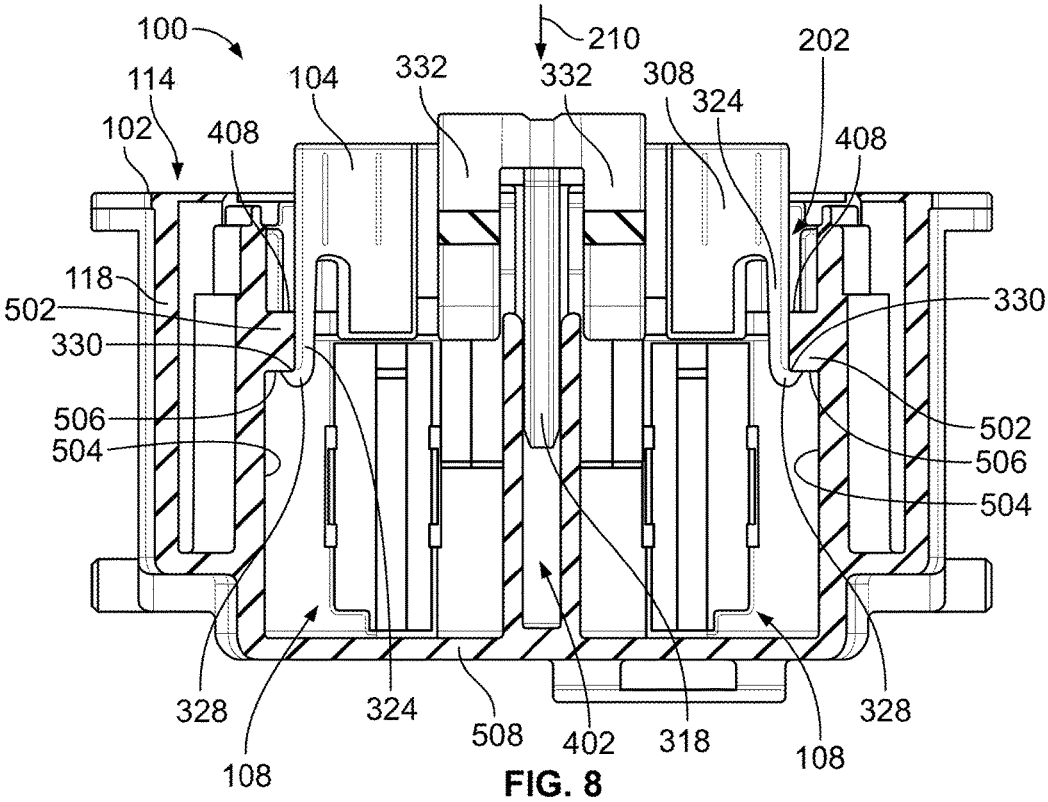
FIG. 8 is a cross-sectional view of the electrical connector showing the TPA member mounted to the housing in an unlocked position according to an embodiment.

In an embodiment, the housing 102 includes partition walls 410 that extend across the TPA slot 202 between the first wall 404 and the second wall 406. The partition walls 410 are disposed laterally between the two cavities 108 of the housing 102. The housing 102 includes two partition walls 410 in the illustrated embodiment. The two partition walls 410 define the guide channel 402 that receives the guide post 318 of the TPA member 104, as shown in FIG. 8. As shown in FIG. 7, the partition walls 410 are shaped to define an enlarged portion 412 of the guide channel 402 at the first wall 404. The enlarged portion 412 is configured to receive the enlarged keying feature 322 of the guide post 318 shown in FIG. 6. Due to the keying feature 322 and the enlarged portion 412 of the guide channel 402, the TPA member 104 is only able to be inserted into the TPA slot 202 of the housing 102 in a single orientation relative to the housing 102.

FIG. 8 is a cross-sectional view of the electrical connector 100 showing the TPA member 104 mounted to the housing 102 in the unlocked position according to an embodiment. The cross-section is taken along the line 8-8 in FIG. 7. FIG. 8 shows the rear side 308 of the TPA member 104, and the cross-section extends through the ridges 334 (shown in FIG. 4) of the locking latches 332. The terminals 106 are not loaded within the cavities 108 of the housing 102 in the illustrated embodiment.

The housing 102 includes ledges 502 that extend into the TPA slot 202 from opposing interior walls 504 of the housing 102. An upper surface of each of the ledges 502 defines a portion of the platform 408 of the housing 102. Lower surfaces 506 of the ledges 502 face towards a back 508 of the mating shroud 118 that is opposite the mating end 114. The ledges 502 may project at least partially into the cavities 108 below the TPA slot 202.

During assembly, the TPA member 104 is moved in the loading direction 210 relative to the housing 102. If the TPA member 104 is properly aligned and oriented with the TPA slot 202 of the housing 102, the guide post 318 enters the guide channel 402 of the housing 102. The distal hook ends 328 of the mounting latches 324 engage and deflect around the ledges 502 of the housing 102. Once the catch surfaces 330 of the distal hook ends 328 pass beyond the lower surfaces 506 of the ledges 502, the mounting latches 324 resiliently move outward such that the catch surfaces 330 overlap the lower surfaces 506. Engagement between the catch surfaces 330 and the lower surfaces 506 of the ledges 502 may retain the TPA member 104 on the housing 102.

Figure 9:
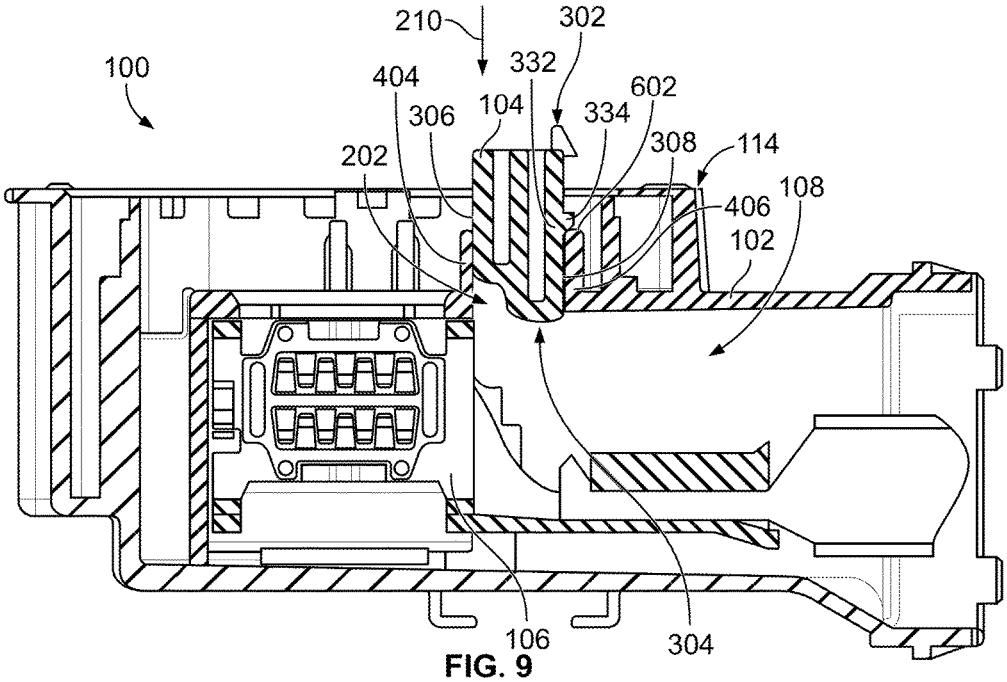
FIG. 9 is a side cross-sectional view of the assembled electrical connector according to an embodiment, showing the TPA member in the unlocked position.

FIG. 9 is a side cross-sectional view of the assembled electrical connector 100 according to an embodiment, showing the TPA member 104 in the unlocked position. In an embodiment, when the TPA member 104 is within the TPA slot 202, the front side 306 of the TPA member 104 engages the first wall 404 of the housing 102, and the rear side 308 of the TPA member 104 engages the second wall 406 of the housing 102. For example, the distance between the first and second walls 404, 406 may be only slightly greater than the thickness of the TPA member 104 between the front and rear sides 306, 308. As shown in FIG. 9, when the TPA member 104 is in the unlocked position, the ridges 334 of the locking latches 332 engage an upper shoulder 602 of the second wall 406. Only one of the ridges 334 is visible in the illustrated cross-sectional view. The upper shoulder 602 of the second wall 406 may be the top end of the second wall 406. The engagement between the ridges 334 and the upper shoulder 602 retains the TPA member 104 in the unlocked position by restricting additional movement of the TPA member 104 in the loading direction 210.

When the TPA member 104 is in the unlocked position, the TPA member 104 does not block the cavities 108, so the terminals 106 are able to be loaded into, and removed from, the housing 102. The illustrated embodiment shows one of the terminals 106 fully loaded within one of the cavities 108. The bottom end 304 of the TPA member 104 does not protrude far enough into the cavity 108 to restrict loading and unloading of the terminal 106. Optionally, the bottom end 304 may not extend into the cavity 108 at all when the TPA member 104 is in the unlocked position, such that the bottom end 304 of the TPA member 104 is disposed within the TPA slot 202. Alternatively, the bottom end 304 may project slightly into the cavity 108 without engaging the terminal 106. In an embodiment, the top end 302 of the TPA member 104 may project beyond the mating end 114 of the housing 102 when the TPA member 104 is in the unlocked position.

Figure 10:
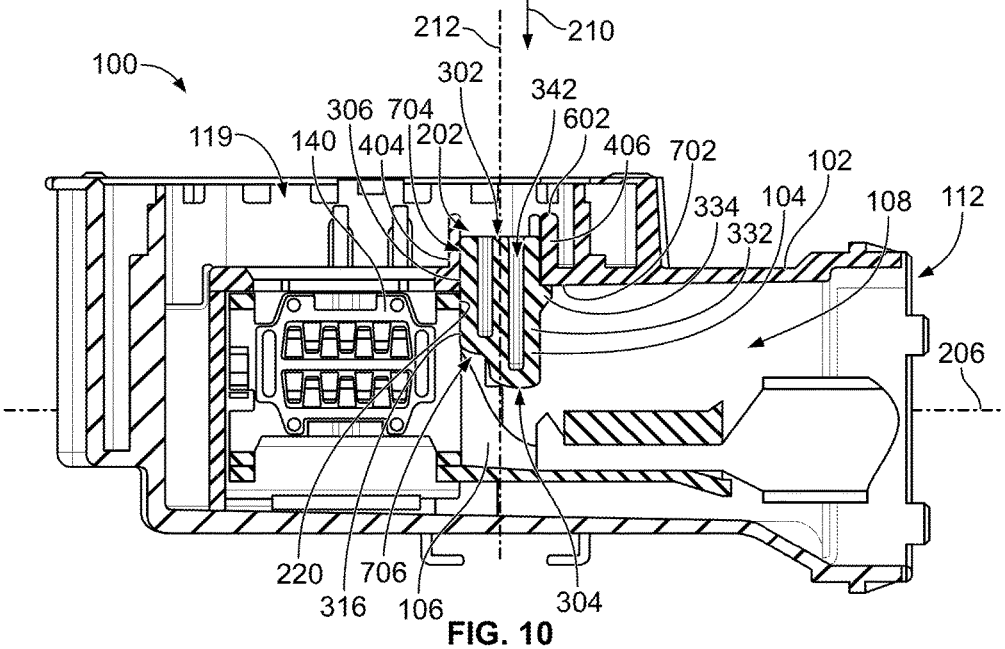
FIG. 10 is a side cross-sectional view of the electrical connector according to an embodiment, showing the TPA member in a locked position.

FIG. 10 is a side cross-sectional view of the assembled electrical connector 100 according to an embodiment, showing the TPA member 104 in the locked position. The TPA member 104 is moved relative to the housing 102 from the unlocked position shown in FIG. 9 to the illustrated locked position along the actuation axis 212, which is perpendicular to the cavity axis 206. The TPA member 104 may be pushed manually by an operator or automatically by the mating connector as the mating connector is mated. The TPA member 104 moves to the locked position in response to a force in the loading direction 210 that is sufficient to cause the locking latches 332 of the TPA member 104 to deflect around the upper shoulder 602 of the second wall 406. For example, the locking latches 332 deflect into the clearance gap 342, allowing the ridges 334 to release from and move beyond the upper shoulder 602.

Figure 11:
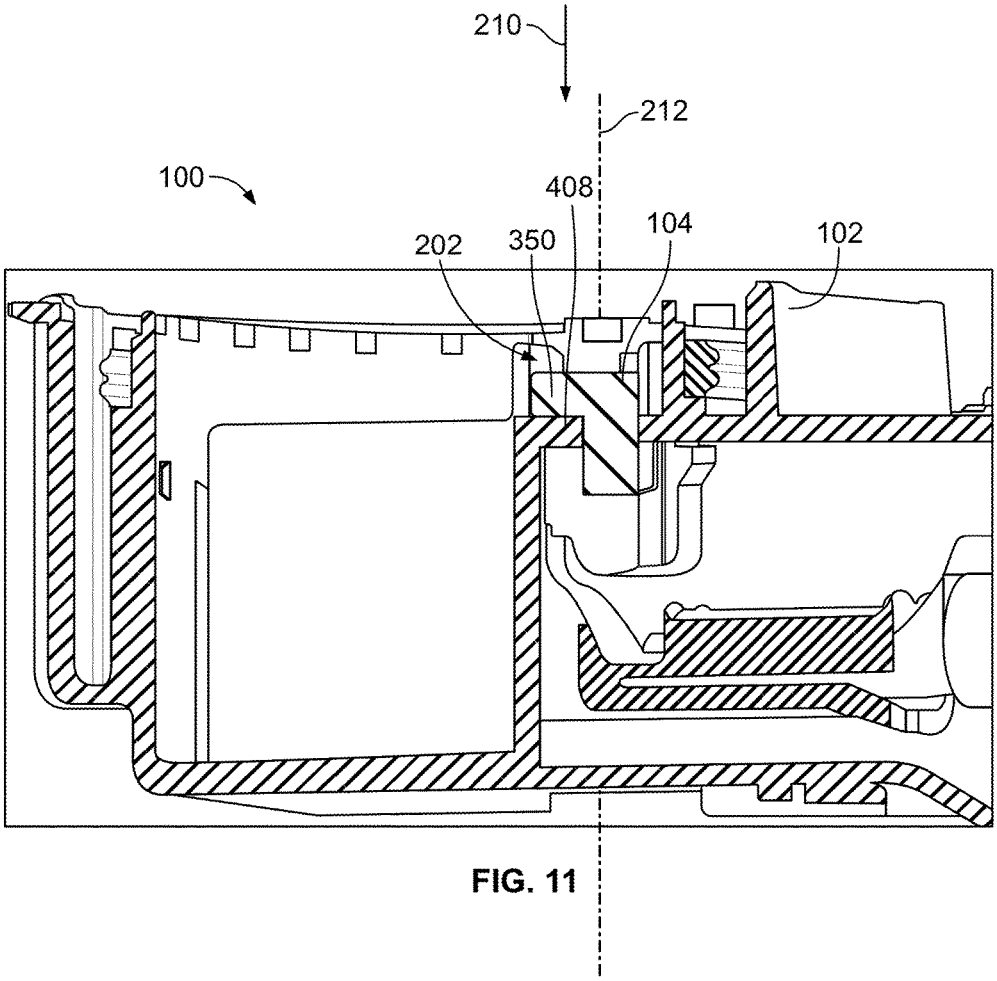
FIG. 11 is a perspective cross-sectional view of the electrical connector according to an embodiment, showing the TPA member in the locked position.

Reference is now directed to FIG. 11, which is a perspective cross-sectional view of the assembled electrical connector 100 showing the TPA member 104 in the locked position. FIG. 11 is similar to FIG. 10 except that the plane of cross-section in FIG. 11 is offset from the plane of cross-section in FIG. 10. When the TPA member 104 is moved towards the locked position, the TPA member 104 moves in the loading direction 210 until the shelf portions 350 of the TPA member 104 abut against the platform 408 of the housing 102. For example, the shelf portions 350 (also shown in FIG. 5) overhang a portion of the platform 408 when the TPA member 104 is loaded in the TPA slot 202. The overhanging shelf portions 350 engage the platform 408 to block additional movement of the TPA member 104 in the loading direction 210 beyond the locked position. Due to the cross-section, only one of the shelf portions 350 is shown in FIG. 11.

Referring now back to FIG. 10, when the TPA member 104 is in the locked position, the TPA member 104 extends into the cavities 108. For example, the bottom end 304 of the TPA member 104 extends into the cavities 108, while an upper portion 704 of the TPA member 104 remains disposed within the TPA slot 202 between the first and second walls 404, 406 of the housing 102. The upper portion 704 may be defined vertically from the top end 302 to the ridges 334 of the locking latches 332. A lower portion 706 of the TPA member 104 that extends between the upper portion 704 and the bottom end 304 may enter the cavities 108.

The blocking surfaces 316 at the front side 306 are configured to engage the back edges 220 of the terminals 106 to retain the terminals 106 within the housing 102. For example, the lower portion 706 of the TPA member 104 projects a sufficient distance into the cavities 108 to overlap the back edges 220 of the terminals 106, effectively extending into a retreat path of the terminals 106. As a result, any rearward movement of the terminals 106 towards the cable end 112 causes the back edges 220 to abut against the blocking surfaces 316. Since the upper portion 704 of the TPA member 104 remains within the TPA slot 202, the engagement between the upper portion 704 and the first and second walls 404, 406 may withstand rotational forces (e.g., torque) exerted on the lower portion 706 of the TPA member 104 by the terminals 106.

In addition to providing a primary lock to retain the terminals 106 in the housing 102, the TPA member 104 may also provide terminal position assurance. For example, if the illustrated terminal 106 is not fully loaded within the cavity 108, the contact segment 140 of the terminal 106 may obstruct the TPA member 104 from moving from the unlocked position to the locked position. The obstructed movement of the TPA member 104 provides an indication that at least one of the terminals 106 is not fully loaded.

In an embodiment, the TPA member 104 in the locked position is blocked from unintentional or premature movement towards the unlocked position by engagement between the ridges 334 of the locking latches 332 and a lower shoulder 702 of the second wall 406. In the locked position, the TPA member 104 may be recessed within the socket 119 of the housing 102.

Figure 12:
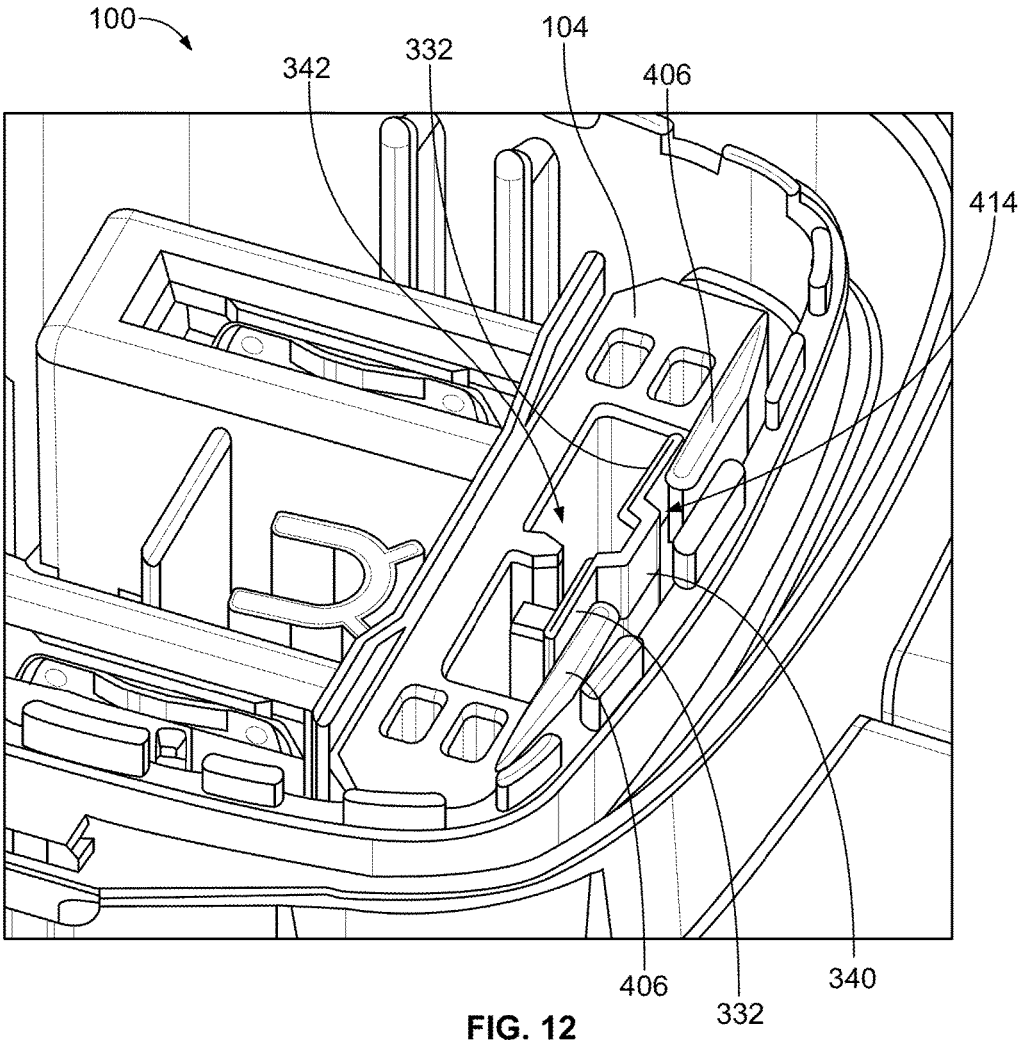
FIG. 12 shows a perspective view of a portion of the electrical connector according to an embodiment, showing the TPA member in the locked position.

Reference is now made to FIG. 12, which shows a perspective view of a portion of the electrical connector 100 according to an embodiment, showing the TPA member 104 in the locked position. In an embodiment, when the TPA member 104 is in the locked position, the tab member 340 of the TPA member 104 is received within the cutout region 414 of the second wall 406. The cutout region 414 provides space for an operator to access the tab member 340 to selectively manually move the tab member 340 into the clearance gap 342. The movement of the tab member 340 deflects the locking latches 332 and releases the ridges 334 (shown in FIG. 10) from the lower shoulder 702 (FIG. 10) of the second wall 406, allowing the TPA member 104 to be moved from the locked position to the unlocked position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing having a cable end and a mating end, the housing defining cavities that extend from the cable end parallel to a cavity axis, the cavities holding corresponding terminals therein that are connected to one or more cables protruding from the cable end, the housing further including a first wall and a second wall that define a terminal position assurance (TPA) slot therebetween, the TPA slot being open to the cavities; and a TPA member mounted to the housing within the TPA slot, the TPA member having a front side that engages the first wall of the housing and a rear side that engages the second wall of the housing, the TPA member being movable relative to the housing between an unlocked position and a locked position along an actuation axis that is perpendicular to the cavity axis, wherein the TPA member in the locked position extends into the cavities and the front side of the TPA member engages respective back edges of the terminals to retain the terminals within the housing.

2. The electrical connector of claim 1, wherein the TPA member in the unlocked position does not extend as far into the cavities as in the locked position such that the TPA member allows loading and unloading of the terminals relative to the cavities when the TPA member is in the unlocked position.

3. The electrical connector of claim 1, wherein the TPA member includes one or more deflectable locking latches along the rear side of the TPA member, each of the locking latches including a ridge protruding rearward from the respective locking latch, the ridge configured to engage an upper shoulder of the second wall of the housing when the TPA member is in the unlocked position to restrict movement towards the locked position, the ridge configured to engage a lower shoulder of the second wall when the TPA member is in the locked position to restrict movement towards the unlocked position.

4. The electrical connector of claim 1, wherein the front and rear sides of the TPA member extend between a top end and a bottom end of the TPA member, wherein, when the TPA member is in the locked position, the bottom end is disposed within the cavities and an upper portion of the TPA member is disposed in the TPA slot of the housing between the first and second walls.

5. The electrical connector of claim 4, wherein the TPA member includes one or more deflectable locking latches along the rear side of the TPA member that engage the second wall of the housing to secure the TPA member in the locked position, each of the locking latches extending from a respective fixed end that is connected to a body of the TPA member to a respective distal, free end, wherein the locking latches extend upward such that the distal, free ends of the locking latches are located more proximate to the top end of the TPA member than the fixed ends.

6. The electrical connector of claim 5, wherein the TPA member includes two locking latches and the distal, free ends of the two locking latches are connected to each other via a tab member.

7. The electrical connector of claim 1, wherein the cable end of the housing is oriented perpendicular to the mating end of the housing, the mating end defining an opening configured to receive a mating connector therein along a mating axis that is perpendicular to the cavity axis, the mating axis being parallel to the actuation axis of the TPA member.

8. The electrical connector of claim 7, wherein the front and rear sides of the TPA member extend between top and bottom ends of the TPA member, wherein the top end of the TPA member faces towards the opening at the mating end when the TPA member is in the locked position.

9. The electrical connector of claim 1, wherein the housing includes a mating shroud at the mating end that defines a socket configured to receive a mating connector therein, the TPA member in the TPA slot circumferentially surrounded by the mating shroud.

10. The electrical connector of claim 1, wherein the front and rear sides of the TPA member extend laterally between a first edge side and a second edge side of the TPA member that is opposite to the first edge side, the TPA member including a deflectable mounting latch at each of the first and second edge sides, the mounting latches configured to engage a lower surface of a ledge of the housing to secure the TPA member on the housing.

11. The electrical connector of claim 1, wherein the front and rear sides of the TPA member extend between a top end and a bottom end of the TPA member, wherein, when the TPA member is in the locked position, the bottom end is disposed within the cavities, wherein the TPA member includes a guide post that protrudes beyond the bottom end of the TPA member and is received within a guide channel of the housing within the TPA slot, the guide post including a keying feature such that the guide post is received in the guide channel in a single orientation.

12. An electrical connector comprising:

a housing having a cable end and a mating end, the cable end of the housing oriented perpendicular to the mating end, the housing defining cavities that extend from the cable end parallel to a cavity axis, the cavities holding corresponding terminals therein that are connected to one or more cables protruding from the cable end, the mating end defining an opening configured to receive a mating connector therein along a mating axis that is perpendicular to the cavity axis, the housing further including a first wall and a second wall that define a terminal position assurance (TPA) slot therebetween, the TPA slot being open to the cavities; and a TPA member mounted to the housing within the TPA slot, the TPA member having a front side that engages the first wall of the housing and a rear side that engages the second wall of the housing, the TPA member being movable relative to the housing between an unlocked position and a locked position along an actuation axis that is perpendicular to the cavity axis and parallel to the mating axis, wherein, when the TPA member is in the locked position, blocking surfaces along the front side of the TPA member extend into the cavities and engage respective back edges of the terminals to block the terminals from moving towards the cable end of the housing, wherein the TPA member extends farther into the cavities and is spaced farther away from the mating end of the housing when in the locked position relative to the unlocked position.

13. The electrical connector of claim 12, wherein the cavities of the housing are disposed side by side in a row and the TPA slot extends across all of the cavities in the row.

14. The electrical connector of claim 12, wherein the front and rear sides of the TPA member extend between a top end and a bottom end of the TPA member, wherein, when the TPA member is in the locked position, the bottom end is disposed within the cavities and an upper portion of the TPA member is disposed in the TPA slot of the housing between the first and second walls.

15. The electrical connector of claim 12, wherein the housing includes a mating shroud at the mating end that defines the opening that receives the mating connector therein, the mating shroud circumferentially surrounding the TPA member in the TPA slot and contact openings of the housing that are configured to receive mating contacts of the mating connector.

16. An electrical connector comprising:

a housing having a cable end and a mating end, the housing defining cavities that extend from the cable end parallel to a cavity axis, the cavities disposed side by side in a row and contain corresponding terminals therein, the housing further including a first wall and a second wall that define a terminal position assurance (TPA) slot therebetween, wherein the TPA slot extends across the cavities in the row and is open to the cavities; and a TPA member mounted to the housing within the TPA slot, the TPA member having a front side that engages the first wall of the housing and a rear side that engages the second wall of the housing, the front and rear sides of the TPA member extending between top and bottom ends of the TPA member, the TPA member being movable relative to the housing between an unlocked position and a locked position along an actuation axis that is perpendicular to the cavity axis, wherein, when the TPA member is in the locked position, the bottom end is disposed within the cavities and an upper portion of the TPA member is disposed in the TPA slot of the housing between the first and second walls, a lower portion of the TPA member within the cavities engages respective back edges of the terminals to block movement of the terminals towards the cable end.

17. The electrical connector of claim 16, wherein the cable end of the housing is oriented perpendicular to the mating end of the housing, the mating end defining an opening configured to receive a mating connector therein along a mating axis that is perpendicular to the cavity axis, the mating axis being parallel to the actuation axis of the TPA member.

18. The electrical connector of claim 16, wherein, when the TPA member is in the unlocked position, the lower portion of the TPA member does not extend as far into the cavities as in the locked position such that the TPA member allows loading and unloading of the terminals relative to the cavities.

19. The electrical connector of claim 16, wherein the TPA member includes one or more deflectable locking latches along the rear side of the TPA member, each of the locking latches including a ridge protruding rearward from the respective locking latch, the ridge configured to engage an upper shoulder of the second wall of the housing when the TPA member is in the unlocked position to restrict movement towards the locked position, the ridge configured to engage a lower shoulder of the second wall when the TPA member is in the locked position to restrict movement towards the unlocked position.

* * * * *